United States Patent [19]

Groch

[11] Patent Number: 4,591,056

[45] Date of Patent: May 27, 1986

[54] ORGANIZER FOR ATTACHE CASES

[76] Inventor: Michael E. Groch, 8207 Bardmoor Pl., #202, Seminole, Fla. 33543

[21] Appl. No.: 780,305

[22] Filed: Sep. 26, 1985

[51] Int. Cl.[4] ..... B65D 1/34

[52] U.S. Cl. ..... 206/564; 206/224; 206/1.7; 206/214; 220/17.1; 220/23.83; 190/110

[58] Field of Search ..... 206/564, 1.8, 1.7, 224, 206/214; 220/17.1, 23.83; 190/110

[56] References Cited

U.S. PATENT DOCUMENTS 1,086,735 2/1914 Spaulding ..... 206/1.7

1,585,032 5/1926 Hess ..... 220/17.1

3,786,913 1/1974 Crawford ..... 206/1.8

*Primary Examiner*—Joseph Man-Fu Moy

*Attorney, Agent, or Firm*—B. P. Fishburne, Jr.

[57] ABSTRACT

A vacuum molded compartmentalized insert is temporarily or permanently installed in one end portion of an attache case, without the necessity of structurally altering the case. Various utility items and supplies can be held in the compartments of the insert, and space is provided in the attache case beneath and at one side of the insert for legal size documents and smaller documents, respectively. The insert is a great convenience for those who must largely work out of their attache cases while traveling.

4 Claims, 5 Drawing Figures

FIG. 1
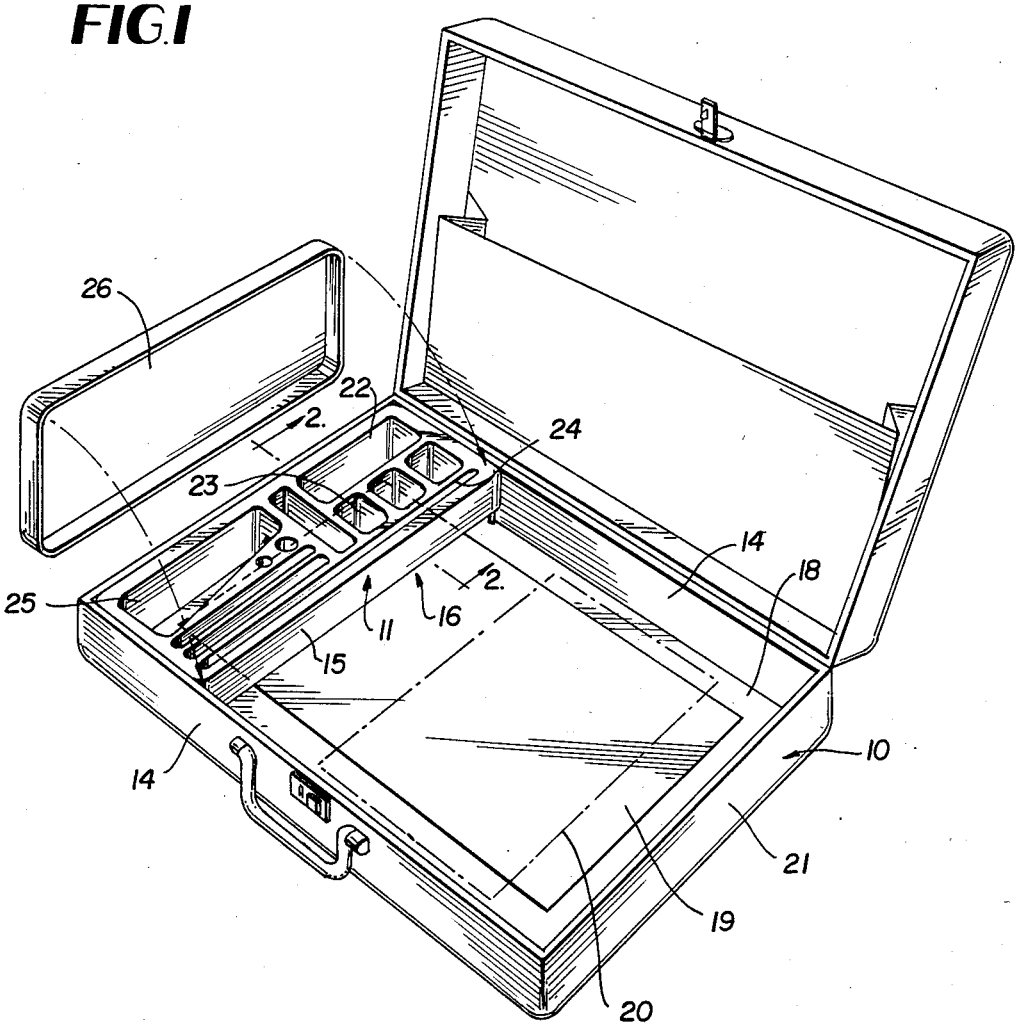
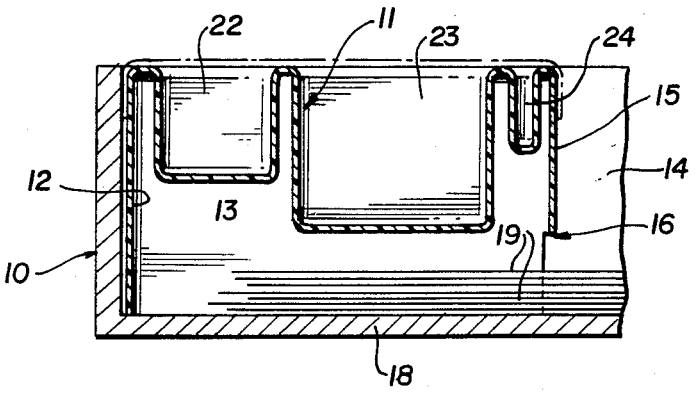
FIG. 2

FIG. 3
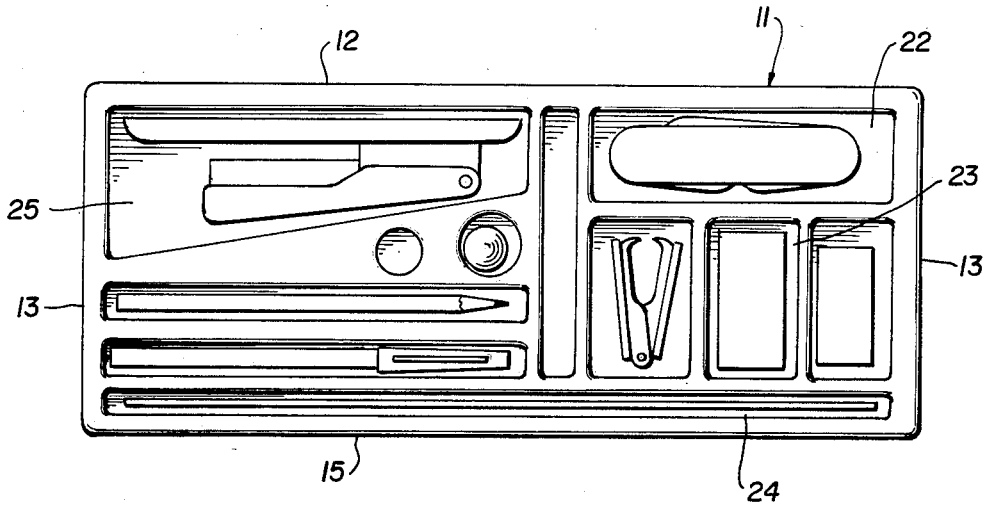
FIG. 4
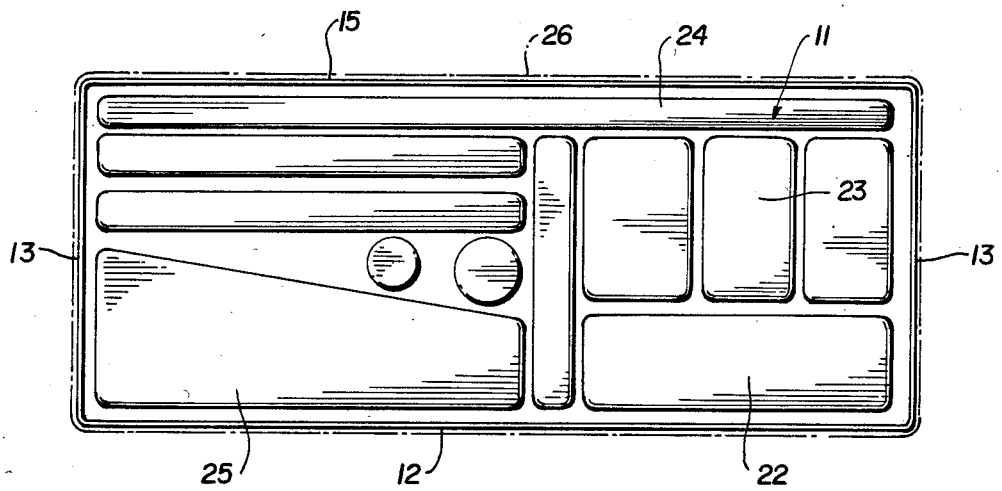
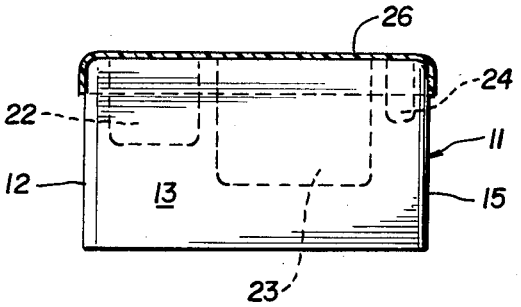
FIG. 5

ORGANIZER FOR ATTACHE CASES

BACKGROUND OF THE INVENTION

The present invention relates to a compartmentalized insert or receptacle for attache cases which enables a convenient and orderly storing of various articles and supplies required by travelers who find it necessary to work largely out of their attache cases over substantial periods of time. Most usually, such travelers including businessmen have a tendency to place supplies and utilitarian items in the case in a completely haphazard manner, resulting in loss of time, inconvenience, and much irritation whenever it is desired to use the supplies or items in the case in connection with the work at hand.

The prior art contains numerous teachings relating to carrying cases having built-in means to better organize materials in the case in order to promote the convenience and efficiency of users. However, in almost all known cases in the prior art, it is required to construct a specially designed carrying case, such as an attache case, to accommodate the alleged improvement, or at least to effect major structural changes in the conventional carrying case. This requirement is unacceptable to manufacturers of carrying cases whose businesses are founded primarily on standardized commercial designs which cannot be deviated from to any great extent without adversely effecting the competitive nature of the product.

Because of the above, there has been no wide commercial acceptance of any known prior art device for better organizing the contents of an attache case or the like, and it is the primary object of this invention to provide an organizing device in the nature of a compartmentalized insert for an attache case which requires no structural modification of the standard commercial case, and is therefore completely acceptable to manufacturers as well as users from an economic standpoint.

A further and more specific object of the invention is to provide an organizer insert for attache cases in the nature of a unitary self-contained lightweight compartmentalized receptacle which can be manufactured in a few sizes to fit into substantially all commercial attache cases produced by various manufacturers. The compartmentalized receptacle or insert can also be furnished to customers in several different styles or models to accommodate articles most commonly needed by business travelers, such as salesmen, accountants, secretaries and others.

Another important object is to provide an organizer insert for attache cases which can be vacuum molded at extremely low cost and which can be installed temporarily or permanently in the attache case in such a way that the general utility of the case for carrying papers and other materials is not lost or interfered with. In this latter connection, the insert is constructed in accordance with an important feature of the invention to accommodate the ends of legal size documents or other long papers beneath it in the attache case, while allowing smaller documents and letters to be placed between the insert and the other end wall of the case.

Other features and advantages of the invention will become apparent to those skilled in the art during the course of the following detailed description.

BRIEF DESCRIPTION OF THE DRAWINGS

FIG. 1 is a perspective view of an attache case having the compartmentalized organizer insert according to the invention installed therein.

FIG. 2 is an enlarged fragmentary vertical section taken on line 2—2 of FIG. 1.

FIG. 3 is a plan view of the insert showing a variety of articles placed therein.

FIG. 4 is a bottom plan view of the insert.

FIG. 5 is an end elevation of the organizer insert showing a removable cover thereon.

DETAILED DESCRIPTION

Referring to the drawings in detail wherein like numerals designate like parts, a standard commercial attache case 10 is illustrated, and within one end portion of the case 10 is installed an organizer insert 11 forming the main subject matter of this invention. The insert 11 can be removably placed in the attache case or can be anchored therein on a more-or-less permanent basis, as with dual side adhesive tape or the like.

The organizer insert 11, which is rectangular, can have its length, width and height altered to fit properly in attache cases of several different standard sizes produced by the industry. It is believed that two or three sizes or models of the invention will suffice in making the invention compatible with the vast majority of attache cases in use and on the market today.

Additionally, the shape, size and number of the compartments in the organizer insert will be varied to meet the diverse needs of different classes of users for equipment and supplies usually carried by them. Again, three styles or models of the insert with variously-shaped and sized compartments are believed to meet substantially the needs of most traveling individuals who require an organizer insert.

Preferably, as shown in the drawings, the organizer insert 11 is formed of plastics material as a unit by a vacuum molding process. This process enables the insert to have a thin wall, although with adequate strength, and to be very light. Tough fracture and tear-resistant plastics can be employed to make the insert 11. Additionally, the insert can be fabricated of wood or metal to satisfy more discriminating tastes.

The insert 11 as shown in FIGS. 1 and 2 matches the depth of the body portion of the attache case 10 and, when in place in the case, is flush with the top of the attache case. The insert includes one longitudinal side wall 12 which lies substantially against one end wall of the case 10 and further includes two relatively shorter end walls 13 which substantially lie against the two longer parallel walls 14 of the case 10 when the insert is installed in the case.

The second longitudinally extending wall 15 of the insert does not contact the floor 18 of the attache case, thereby providing a tunnel passage 16 which extends the length of the insert. The lower edges of walls 12 and 13 rest solidly on the floor 18 of the attache case when the organizer insert 11 is installed therein.

The tunnel passage 16 is an important aspect of the invention, in that it allows legal size and other long documents 19 to be placed in the attache case and to lie flat therein with end portions thereof extending through the tunnel passage 16 and beneath the organizer insert, as best shown in FIG. 2. Smaller documents 20, such as letters, may be placed in the case 10 in the large unobstructed area between the insert 11 and the distant case end wall 21, FIG. 1.

In the fabrication of the insert 11, a plurality of top opening depressed compartments 22, 23, 24, 25 are formed. The number, shape, size and depths of these compartments can vary as shown in the drawings. The deepest compartment 23 will have its bottom wall no lower than the top edge of the tunnel passage 16, to assure proper clearance space beneath the insert 11 for the long documents 19.

The shapes of the various compartments of the insert 11 will vary, as explained, to enable the orderly carrying of various items of utility and supplies. The particular arrangement shown in the drawings is illustrative only and is not to be taken in a limiting sense.

It can now be seen that the invention provides an inexpensive means to organize the traveler's most frequently used supplies and working implements so that these items need not be haphazardly placed in the attache case in complete disarray. The insert, at the same time, does not diminish the regular utility of the attache case for carrying documents of all sizes, stationery, files and the like. In fact, the organizer insert enhances the overall convenience and utility of the carrying case without significantly adding to its cost, while adding nearly nothing to its weight.

For the sake of simplicity of illustration, the drawings do not show a slight draft angle required on the side walls of the depressed compartments and the side walls of the rectangular insert, required to separate the insert from its mold. The draft angle is sufficiently small so as not to interfere with the proper disposition of the device in the attache case, taking into account that the thin walls of the insert 11 are inherently yielding.

Finally, as depicted in FIG. 5, a simple vacuum molded rectangular slip cover 26 for the compartmentalized organizer insert 11 is provided. The slip cover 26 is required to prevent the contents of the compartments from spilling out when the case is being carried by its handle or is otherwise upended or inverted. However, when the user as while traveling on an airplane or otherwise working out of the attache case, the slip cover 26 may simply be removed and set aside temporarily and later replaced on the insert 11 when the attache case is being closed.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An organizer insert for a rectangular carrying case comprising a unitary substantially rectangular elongated insert body adapted to fit snugly into one end portion of a rectangular case while extending substantially for the distance between the longitudinal walls of the case and substantially abutting one end wall of the case, the insert body having a height whereby it can rest on the floor of a case with its top face substantially flush with the top of the body portion of a case, the insert body having a plurality of open top depressed storage compartments of various depths and marginal shapes so that they can receive various articles therein, the insert body further including one longitudinal wall and two end walls whose lower edges can rest on the floor of a case stably and another longitudinal wall whose lower edge is elevated from the floor thereby forming a tunnel passage, whereby papers and the like resting on the floor of a case can project through the tunnel passage and beneath the compartments of the insert body, and a cover means for the top of the insert body.

2. An organizer insert for a rectangular carrying case as defined in claim 1, and the bottom wall of the deepest storage compartment of the insert body lying at an elevation such that it will not impede insertion of materials such as long papers into the tunnel passage.

3. An organizer insert for placement in one end portion of a rectangular attache case and adapted to span the distance between the two longitudinal walls of such case while abutting one end wall thereof and resting on the floor of the case and having its top substantially flush with the top of the body of the case, said insert comprising a unitary body portion having a top wall and a plurality of variously sized and shaped depressed open top diverse article storage compartments formed in the top wall, the body portion being substantially rectangular and elongated and having one longitudinal wall and two end walls of equal heights depending from the top wall and defining the margin of the insert, and the body portion having another longitudinal wall whose lower edge is elevated from the floor of the case thereby forming a tunnel passage for papers and the like between said two end walls.

4. An organizer insert as defined in claim 3, and a removable cover for the insert body portion forming a closure for the open tops of said compartments.

* * * * *